US005314368A

United States Patent [19]

Cheng

[11] Patent Number: 5,314,368

[45] Date of Patent: May 24, 1994

[54] FLYING BALL APPARATUS

[76] Inventor: Peter S. C. Cheng, 5 Ross Street, Toronto, Ontario, Canada, M5T 1Z8

[21] Appl. No.: 13,032

[22] Filed: Feb. 3, 1993

[51] Int. Cl.[5] ..... A63H 23/10; G09F 19/02

[52] U.S. Cl. ..... 446/179; 446/34; 446/168; 446/179; 446/176; 40/406; 40/409; 40/439

[58] Field of Search ..... 446/34, 168, 178, 179, 446/176; 273/362; 40/406, 409, 439

[56] References Cited

U.S. PATENT DOCUMENTS 2,055,498 9/1936 Jacobs ..... 40/409 X
2,100,690 11/1937 Andler ..... 40/409 X
2,464,460 3/1949 Pack ..... 40/409
3,115,343 12/1963 Lemchon ..... 446/179 X
4,193,470 3/1980 Logan ..... 446/179 X

FOREIGN PATENT DOCUMENTS 2053008 2/1981 United Kingdom ..... 446/179

*Primary Examiner*—Danton D. DeMille
*Attorney, Agent, or Firm*—Kirschstein et al.

[57] ABSTRACT

A toy or display suspends a ball in mid-air and moves the ball in a closed path without any visible means of support above a housing. The ball is moved radially toward, and alternately away from, a central housing axis, and may also be raised and lowered in elevation during its travel along the path.

10 Claims, 2 Drawing Sheets

FLYING BALL APPARATUS

BACKGROUND OF THE INVENTION

1. Field of the Invention

This invention generally relates to an action toy or a dynamic display and, more particularly, to an apparatus for suspending and moving a lightweight element in mid-air in a controlled manner without any visible means of support.

2. Description of Related Art

Toys and displays having air-floating balls or flying saucers movable along a circular path or orbit are known. See, for example, U.S. Pat. Nos. 2,897,607; 2,924,033; 3,082,570; 3,083,497 and 4,292,755.

Although entertaining at first, experience has shown, however, that such apparatuses become uninteresting and less attention-holding after an extended period of time due, primarily, to the fact that the ball or saucer travels in a predetermined, predictable, circular path along a plane.

SUMMARY OF THE INVENTION

1. Objects of the Invention

It is a general object of this invention to provide an entertaining and interesting apparatus suitable for use as an action toy or a dynamic display.

It is another object of this invention to provide an attention-holding apparatus in which an element is suspended and moved in mid-air in a controlled manner without any visible means of support.

Another object of this invention is to alternately raise and lower, and simultaneously alternately move radially in and out, an element supported in mid-air in a closed path above a housing.

2. Features of the Invention

In keeping with these objects, and others which will become apparent hereinafter, one feature of this invention resides, briefly stated, in an apparatus comprising a housing having an upright housing axis, an element, and means in the housing for directing a flow of air to the element with sufficient force to support the element in mid-air above the housing.

In accordance with this invention, means are provided for moving the air-supported element in a non-circular path relative to the housing axis. More particularly, such means includes means for continuously raising, and alternately lowering, the air-supported element relative to the housing, in a repetitive manner, along the path. Still more particularly, the moving means further includes means for continuously moving the air-supported element radially toward the housing axis and, alternately, radially away from the housing axis, in a repetitive manner, along the path.

In the preferred embodiment, the element is a lightweight spherical ball made of foam. The moving means includes a carriage mounted for movement on at least one rail, and preferably on a pair of rails concentric with the housing axis Each rail has a variable undulating height as considered in a circumferential direction. The rails are arranged such that the height of one of the rails is at a maximum when the height of the other of the rails is at a minimum, and vice versa. In this manner, the carriage tilts relative to the housing as it is driven along the rails by an on-board drive.

Also mounted on-board the carriage is the directing means which advantageously is an air blower. The air blower tilts with the carriage and thereby directs the air flow and, concomitantly, moves the air-supported element radially toward and away from the housing axis during such tilting movement.

In accordance with another feature of this invention, an apertured screen is mounted atop the housing. The screen has an annular section having openings with different flow-through areas as considered along the circumferential direction. Some of the openings are wider and, hence, enable a greater quantity of the air flow to pass therethrough to support the element at a higher elevation relative to the screen. Other openings are narrower in their flow-through cross-section and, hence, they deliver a lesser quantity of the air flow to the element, thereby supporting the element at a lower elevation relative to the screen. By alternately staggering the wider and narrower openings along the circumferential direction, the elevation of the element is changed.

In accordance with this invention, the element is supported and moved in a controlled up-and-down and in-and-out manner along a closed path above the housing without any visible means of support, thereby serving as an entertaining and attention-holding toy or display.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
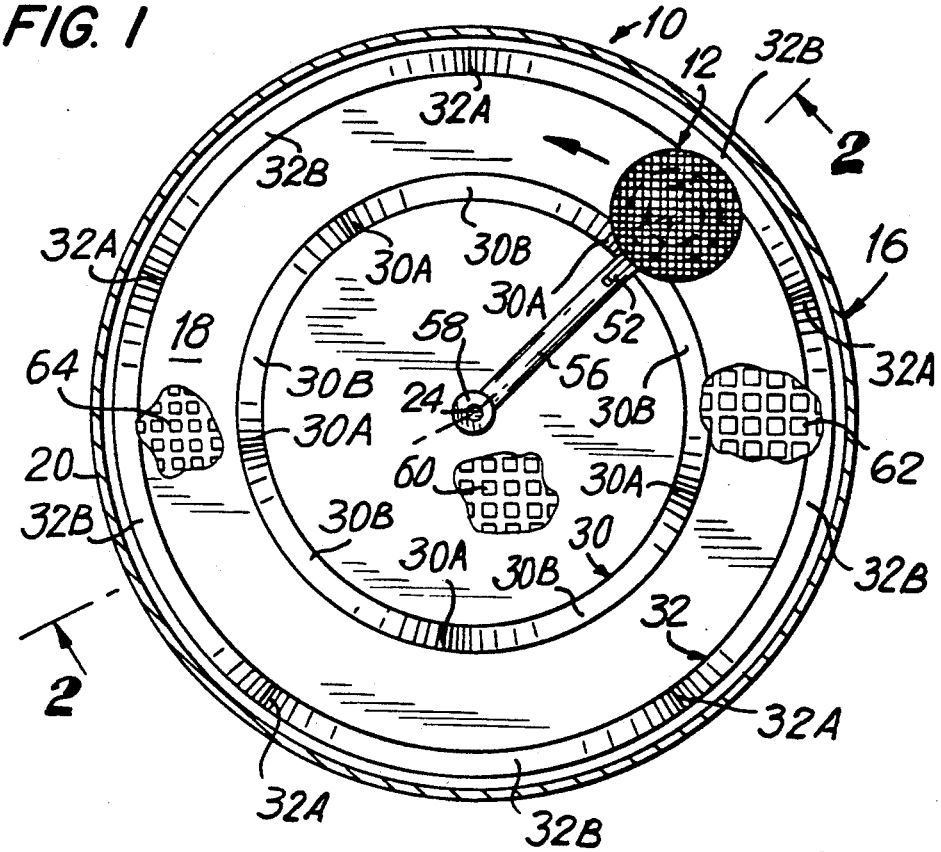
FIG. 1 is a top plan view of an apparatus for suspending and moving an element in mid-air along a closed path in accordance with this invention.

Referring now to the drawings, reference numeral 10 generally identifies an apparatus for suspending and moving an element 12 in mid-air along a closed path 14 above a housing 16 without any visible means of support. The path 14 of the element 12 is depicted in plan view in FIG. 3 and in side elevational view in FIG. 4.

The housing 16 has a base 18, a circular side wall 20 extending upwardly from the base 18, and an apertured mesh or screen 22 extending over, and mounted on, the side wall 20 above and parallel to the base 18. An upright shaft 24 extending along a housing axis 26 is centrally mounted on the base 18 and is vertically supported by a mount 28.

Figure 5:
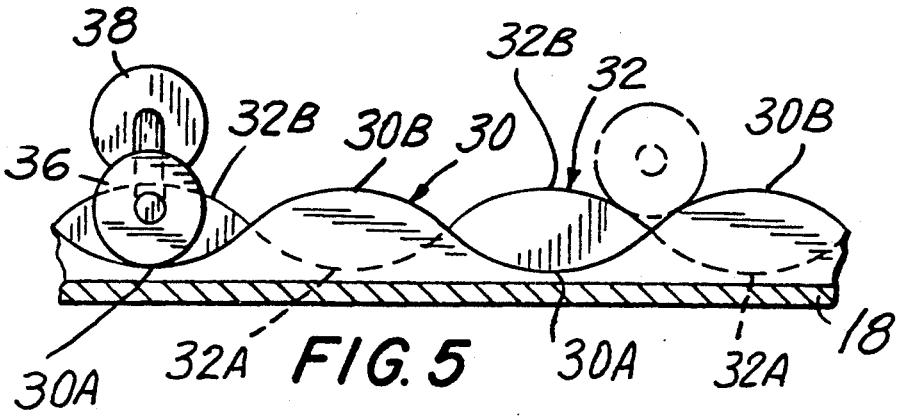
FIG. 5 is an enlarged, sectional view taken on line 5—5 of FIG. 2.

An annular track is mounted on the base 18. The track includes at least one rail, and preferably a pair of rails 30, 32, both concentric with the housing axis 26. Each rail has a continuously-variable, undulating height as considered along the circumferential direction around the housing axis 26. Thus, as shown in FIG. 1, inner rail 30 has valleys 30A alternating with peaks 30B; and outer rail 32 has valleys 32A alternating with peaks 32B. Each valley on a respective rail merges continuously and smoothly into its adjacent peaks. As considered along the radial direction, each valley on the inner rail 30 is aligned with each peak on the outer rail 32. See, especially, FIG. 5 wherein the alignment and sinusoidal variation of the height along the rails are illustrated.

The carriage 34 is supported by inner wheels 36 and outer wheels 38 respectively mounted on the inner and outer rails 30, 32. Carriage 34 is elongated along a carriage axis 40. The wheels 36,38 are coupled to a reduction gear transmission 42 which, in turn, is coupled to a drive shaft of a drive or DC motor 44 on-board the carriage 34. A battery pack 46 electrically powers the DC motor 44. The drive shaft of the motor 44 is also coupled to a fan blade 48. A protective mesh 50 overlies the fan blade 48. Motor 44 is operative to drive the carriage 34 along the rails 30, 32, and also to rotate the fan blade 48 to direct a flow of air to the element 12 with sufficient force to support the element 12 on a column of air above the screen 22.

The element 12 is preferably a sphere or ball constituted of a lightweight material such as foam plastic. Element 12 can also be shaped as a saucer or, indeed, may have any desirable shape. In some applications, the element 12 may have generally planar wings or apertures extending therethrough to help stabilize the position of the element in mid-air. The element 12 may also be equipped with curved wings to spin the element about its own axis during flight.

Figure 2:
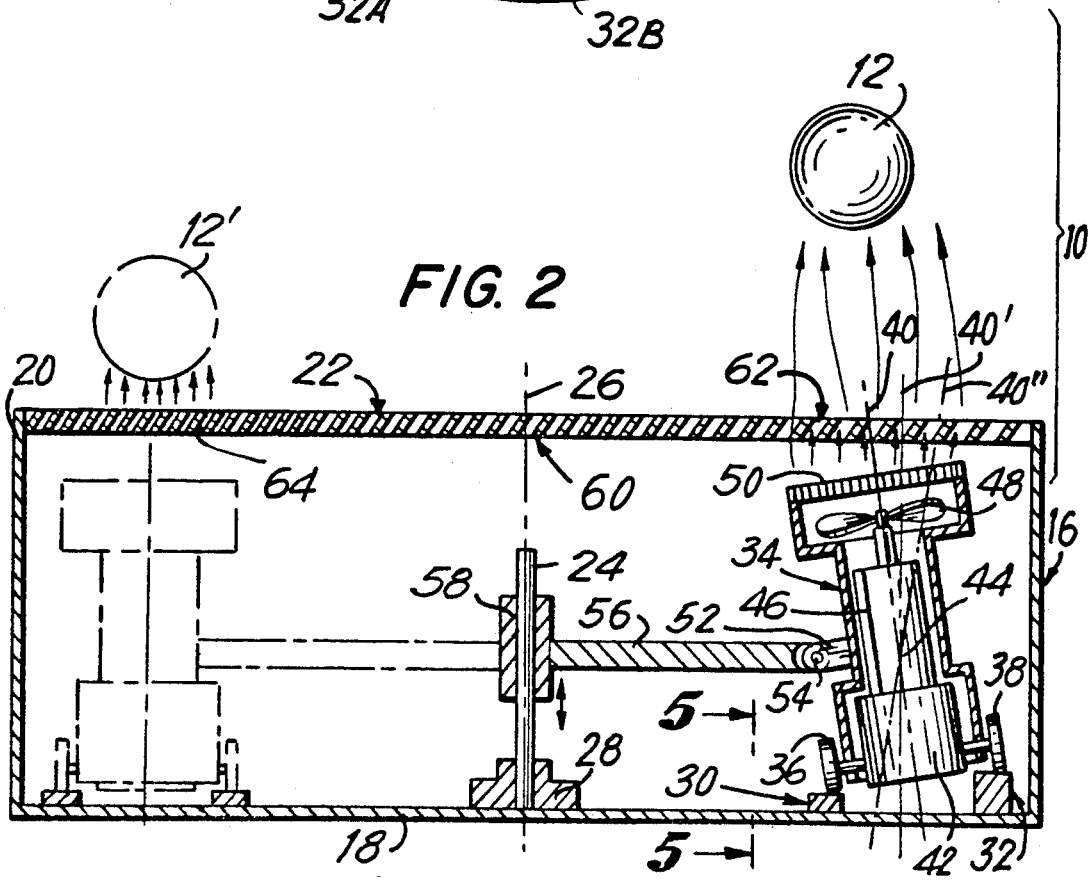
FIG. 2 is a sectional view taken on line 2—2 of FIG. 1.
Figure 3:
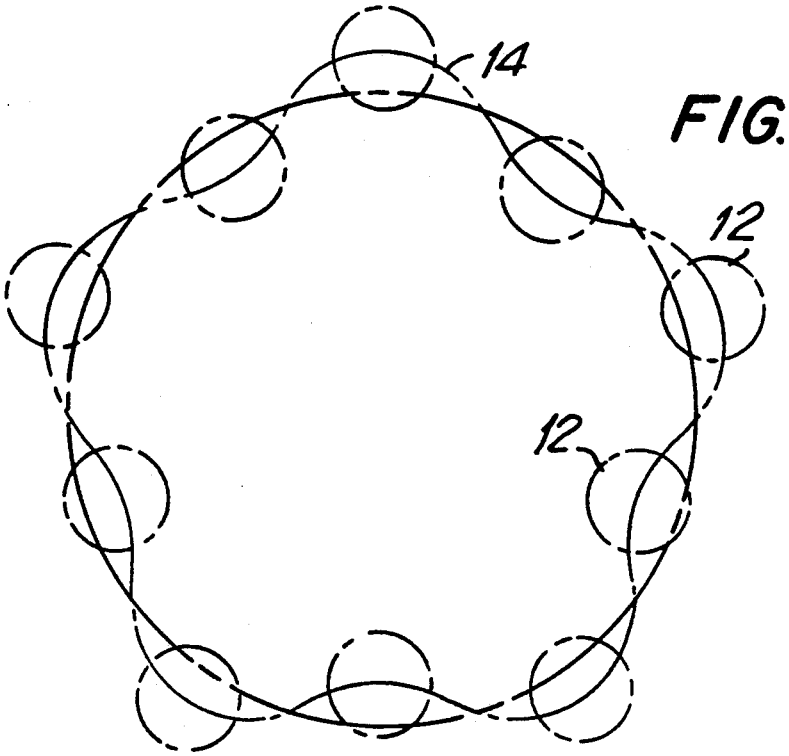
FIG. 3 is a top plan view of the path traveled by the element during use of the apparatus.
Figure 4:
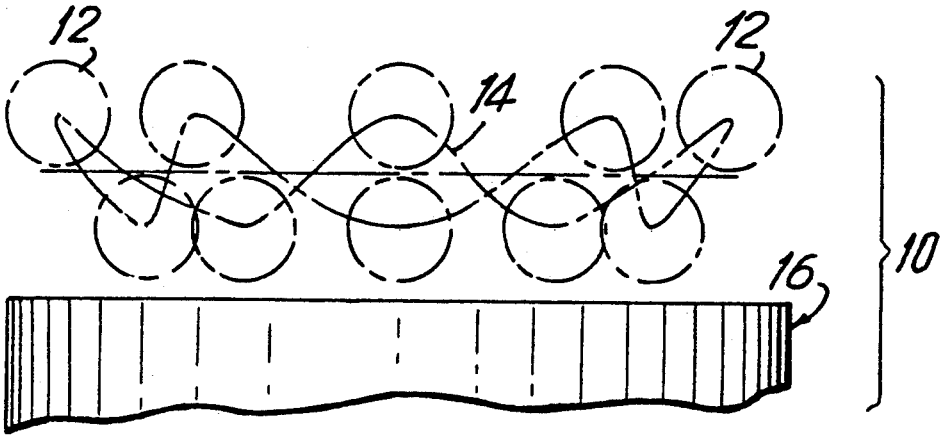
FIG. 4 is a side elevational view of the path traveled by the element during use of the apparatus.

As best seen in FIG. 2, the carriage 34 has an elongated link 52 pivotably mounted at a pivot 54 to one end of an elongated arm 56 whose other end is connected to a sleeve 58 slidably mounted for movement on and along the shaft 24. As the motor 44 drives the carriage along the rails, the carriage 34 tilts and pivots about the pivot 54, thereby inclining the carriage axis 40. The carriage axis is tilted toward the left in FIG. 2 when inner wheel 36 is lower in elevation than outer wheel 38, extends strictly vertically (see position 40') when the inner wheel 36 and the outer wheel 38 are at the same elevation, and is tilted toward the right (see carriage axis 40") when the inner wheel 36 is higher in elevation than the outer wheel 38. During this repeated tilting of the carriage and its axis, the air flow emitted by the fan blade 48 steers the air-supported element 12 radially toward and away from the housing axis 26, as depicted in FIG. 3.

In addition to the aforementioned "in-and-out" movement described above, the element 12 can also be raised and lowered during its movement along the closed path 14. For this purpose, the air flow directed to the element 12 is varied. This can be accomplished in various ways. For example, the speed of the fan blade 48 can be electronically controlled to alternately accelerate or decelerate. Alternatively, air flow can be controlled mechanically by alternately spacing differently sized openings in the apertured screen 22.

Thus, the screen 22 has a central section having baffles spaced apart to define therebetween apertures 60 of a certain flow-through cross-section. The screen 22 also has a circular peripheral section surrounding its central section. The peripheral section also has baffles which ar deliberately spaced apart to define wider apertures 62 of a larger flow-through cross-section, as well as narrower apertures 64 of a smaller flow-through cross-section. The wider apertures 62 allow more of the emitted air from the fan blade 48 to reach the element, thereby raising the same to a higher elevation (see element 12 at right side of FIG. 2). The narrower apertures 64 allow less of the emitted air to reach the element 12, thereby lowering the same to a lower elevation (see element 12' at the left side of FIG. 2). The wider 62 and narrower 64 apertures alternate with one another as considered along the circumferential direction. During the travel of the carriage 34 underneath the circular peripheral section of the screen 22, the air flow emitted by the fan blade 48 alternately increases and decreases in volume, thereby respectively raising and lowering the element 12, a situation depicted in FIG. 4. The aforementioned "in-and-out" effect can also be mechanically achieved by the screen itself without relying on tilting the carriage. Thus, the baffles situated in the circular peripheral section of the screen can be inclined either toward the right or the left to varying degrees, thereby directing the flow of air and the air-supported element toward the right or left to travel in the closed path 14.

It will be understood that each of the elements described above, or two or more together, also may find a useful application in other types of constructions differing from the types described above.

While the invention has been illustrated and described as embodied in a flying ball apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. An action apparatus comprising:
(a) a housing having an upright housing axis, a base and an annular track mounted on the base, said track having at least one rail of variable undulating height as considered in a circumferential direction around the track;
(b) an element;
(c) means in the housing for directing a flow of air to the element with sufficient force to support the element in mid-air above the housing; and
(d) means for moving the air-supported element in a non-circular path relative to the housing axis.

2. The action apparatus according to claim 1, wherein the track has another rail concentric with said at least one rail and also having a variable undulating height along the circumferential direction, the height of one of the rails being at a maximum when the height of the other of the rails is at a minimum, and vice versa.

3. The action apparatus according to claim 2, wherein the moving means includes a carriage mounted for movement on and along the rails, and wherein the directing means is mounted on the carriage for joint movement therewith, and wherein the moving means includes a drive mounted on the carriage for driving the carriage and the directing means along the rails.

4. The action apparatus according to claim 3, wherein the carriage is mounted for tilting movement relative to the housing, and wherein the air-supported element is moved radially toward and away from the housing axis during such tilting movement.

5. An action apparatus, comprising:

(a) a housing having an upright housing axis, a base and a screen mounted above the base, said screen having openings;

(b) an element;

(c) means in the housing for directing a flow of air through the openings to the element with sufficient force to support the element in mid-air above the housing;

(d) said screen having an annular section along which the openings have different flow-through areas, the openings including wider screen areas through which a greater quantity of the air flow passes to support the element at a higher elevation relative to the screen as compared to narrower screen areas through which a lesser quantity of the air flow passes to support the element at a lower elevation relative to the screen; and (e) means for moving the air-supported element in a non-circular path relative to the housing axis.

6. The action apparatus according to claim 5, wherein the openings at the annular section are formed by baffles inclined at different angles of inclination relative to the housing axis, as considered along the circumferential direction around the annular section.

7. An action apparatus, comprising:

(a) a housing having an upright housing axis;

(b) an element;

(c) means in the housing for directing a flow of air to the element with sufficient force to support the element in mid-air above the housing; and (d) means for moving the air-supported element in a circumferentially-complete non-circular path relative to the housing axis, said moving means including means for continuously moving the air-supported element radially toward the housing axis and, alternately, radially away from the housing axis, in a repetitive manner, along the path.

8. The action apparatus according to claim 7, wherein the element includes at least one lightweight ball shaped generally as a sphere.

9. The action apparatus according to claim 7, wherein the housing is an annular enclosure in which the directing means and the moving means are mounted.

10. The action apparatus according to claim 7, wherein the moving means incldues means for continuously raising, and alternately lowering, the air-supported element relative to the housing, in a repetitive manner, along the path.

* * * * *